US011081037B2

(12) United States Patent
Liu et al.

(10) Patent No.: US 11,081,037 B2
(45) Date of Patent: Aug. 3, 2021

(54) DISPLAY PANEL INCLUDING DATA SIGNAL TRANSMISSION CIRCUIT, DATA SIGNAL STORAGE CIRCUIT WITH TWO STORAGE UNITS, AND DATA SIGNAL WRITING CIRCUIT

(71) Applicant: SeeYA Optronics Co., Ltd., Shanghai (CN)

(72) Inventors: Ping-Lin Liu, Shanghai (CN); Haodong Zhang, Shanghai (CN)

(73) Assignee: SEEYA OPTRONICS CO., LTD., Shanghai (CN)

( * ) Notice: Subject to any disclaimer, the term of this patent is extended or adjusted under 35 U.S.C. 154(b) by 0 days.

(21) Appl. No.: 17/007,019

(22) Filed: Aug. 31, 2020

(65) Prior Publication Data

US 2021/0110750 A1 Apr. 15, 2021

(30) Foreign Application Priority Data

Oct. 11, 2019 (CN) ..... 201910962928.0

(51) Int. Cl.
*G09G 3/20* (2006.01)

(52) U.S. Cl.
CPC ..... *G09G 3/20* (2013.01); *G09G 2310/027* (2013.01)

(58) Field of Classification Search
CPC ..... G09G 3/20; G09G 2310/027
See application file for complete search history.

(56) References Cited

U.S. PATENT DOCUMENTS 10,290,263 B2 * 5/2019 Hwang ..... G09G 3/3266
2004/0227717 A1 * 11/2004 Yeh ..... G09G 3/3648 345/100
2007/0090347 A1 * 4/2007 Park ..... G09G 3/3283 257/40

FOREIGN PATENT DOCUMENTS

CN 1866341 A 11/2006
CN 104950543 A 9/2015
CN 109036292 A 12/2018
KR 100582674 B1 5/2006

OTHER PUBLICATIONS

Chines Office Action dated May 10, 2021, Application No. 201910962928.0.

* cited by examiner

*Primary Examiner* — Kwang-Su Yang
(74) *Attorney, Agent, or Firm* — The Dobrusin Law Firm, P.C.

(57) ABSTRACT

A display panel is provided. The display panel includes sub-pixels arranged in an array, pixel driving circuits corresponding to sub-pixels in each column being connected through at least one data line. One data driving process for the sub-pixels includes: a first phase in which a data signal transmission circuit writes a data signal for an n-th row into a data signal storage circuit, and a second phase in which a data signal writing circuit receives the data signal output by the data signal storage circuit and writes the data signal into pixel driving circuits corresponding to sub-pixels in the n-th row, and the second phase of the data driving process for the n-th row is reused as the first phase of the data driving process for a (n+1)-th row, where n is a positive integer.

9 Claims, 14 Drawing Sheets

DISPLAY PANEL INCLUDING DATA SIGNAL TRANSMISSION CIRCUIT, DATA SIGNAL STORAGE CIRCUIT WITH TWO STORAGE UNITS, AND DATA SIGNAL WRITING CIRCUIT

CROSS-REFERENCE TO RELATED APPLICATIONS

The present application claims priority to Chinese Patent Application No. 201910962928.0, filed on Oct. 11, 2019, the content of which is incorporated herein by reference in its entirety.

TECHNICAL FIELD

The present disclosure relates to the field of display technologies, and in particular, to a display panel.

BACKGROUND

With the development of display technologies, there is an increasing demand for high-resolution and high-definition display panels. For example, in applications such as virtual reality (VR) and augmented reality (AR), since the display panel is close to eyes, higher resolution is required in order to obtain a good user experience.

Pixel units in the display panel are generally arranged in an array, and display is implemented by loading data signals row by row. For high-resolution display panels, display time for each row is very short. For example, for an organic light-emitting device, operations, such as initialization, threshold compensation and driving a data line to write data signal, are required to be performed within the time period for displaying one row. The higher the resolution, the shorter the time allocated to each step. Moreover, as the resolution increases, a load of the source driver will increase by multiples, which will affect response time of the source driver.

SUMMARY

Embodiments of the present disclosure provide a display panel, a driving method, and a display device. The display panel divides a data driving process for sub-pixels into two phases and reuses a second phase of an n-th row of sub-pixels as a first phase of a (n+1)-th row of sub-pixels in a time division multiplexing (TMD) manner, so as to achieve driving of high-resolution sub-pixels and solve the contradiction between resolution and driving time.

In a first aspect, an embodiment of the present disclosure provides a display panel, comprising: a plurality of sub-pixels arranged in an array, wherein pixel driving circuits corresponding to sub-pixels in each column of the plurality of sub-pixels are connected through at least one data line; a data signal transmission circuit; a data signal storage circuit; and a data signal writing circuit; wherein an output terminal of the data signal transmission circuit is connected to an input terminal of the data signal storage circuit, an output terminal of the data signal storage circuit is connected to an input terminal of the data signal writing circuit, and an output terminal of the data signal writing circuit is connected to the at least one data line; and wherein a data driving process for the plurality of sub-pixels comprises: a first phase in which the data signal transmission circuit is configured to write a data signal for an n-th row of sub-pixels of the plurality of sub-pixels into the data signal storage circuit, and a second phase in which the data signal writing circuit is configured to receive the data signal output by the data signal storage circuit and write the data signal into pixel driving circuits corresponding to sub-pixels in the n-th row, and the second phase of the data driving process for the n-th row of sub-pixels is reused as the first phase of the data driving process for a (n+1)-th row of sub-pixels of the plurality of sub-pixels, where n is a positive integer. The display panel provided by the embodiment of the present disclosure includes a plurality of sub-pixels arranged in an array, and pixel driving circuits corresponding to sub-pixels in each column are connected through at least one data line. The display panel further includes the data signal transmission circuit, the data signal storage circuit, and the data signal writing circuit; the output terminal of the data signal transmission circuit is connected to the input terminal of the data signal storage circuit, the output terminal of the data signal storage circuit is connected to the input terminal of the data signal writing circuit, and the output terminal of the data signal writing circuit is connected to the at least one data line. The driving of high-resolution sub-pixels is realized and the contradiction between resolution and driving time is eliminated by dividing a data driving process for the sub-pixels into a first phase and a second phase: in the first phase, the data signal transmission circuit writes the data signal for the n-th row of sub-pixels into the data signal storage circuit, and in the second phase, the data signal writing circuit receives the data signal output by the data signal storage circuit and writes the data signal into the pixel driving circuits corresponding to the sub-pixels in the n-th row, and the second phase of the data driving process for the n-th row of sub-pixels is reused as the first phase of the data driving process for the (n+1)-th row of sub-pixels.

DESCRIPTION OF EMBODIMENTS

Figure 1:
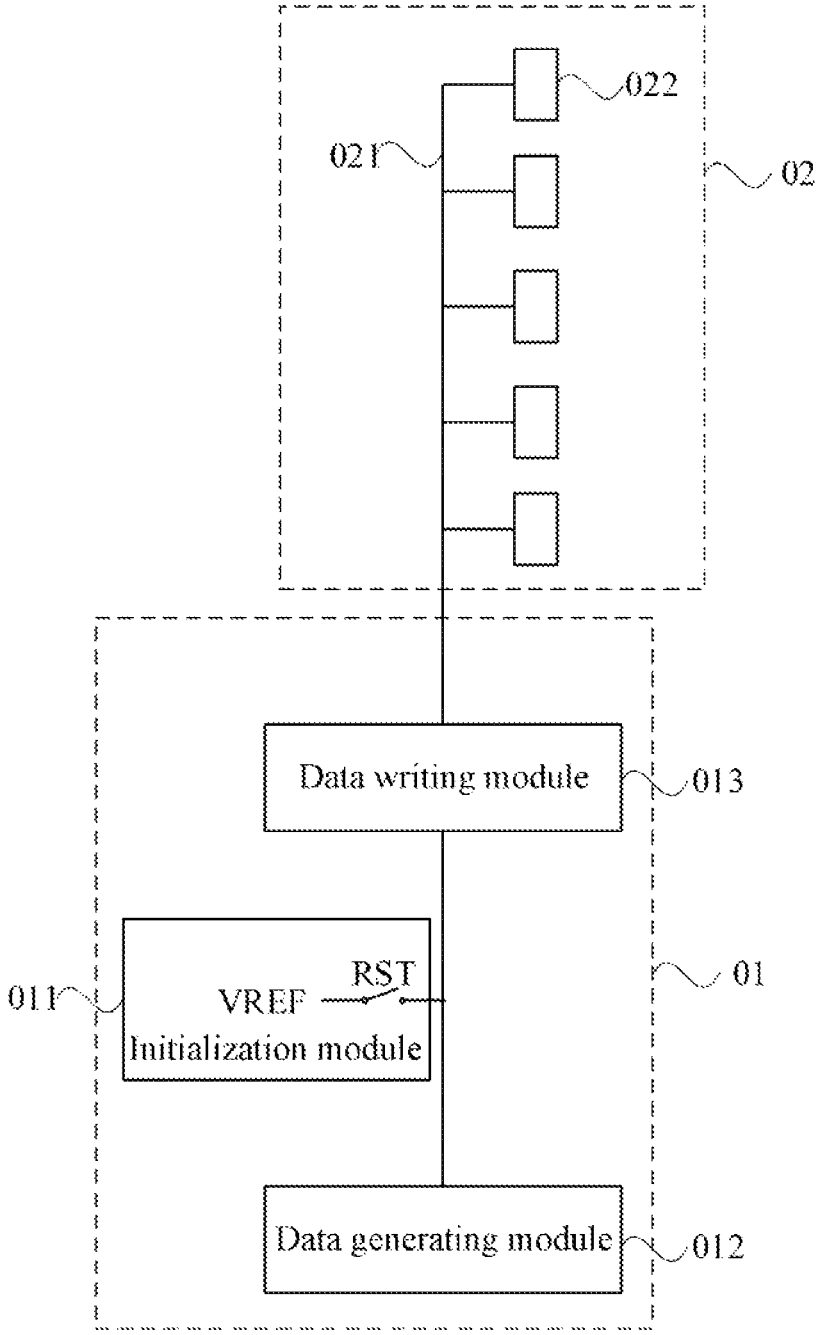
FIG. 1 (Prior Art)
FIG. 1 illustrates a structural schematic diagram of a source driving circuit of a display device in the related art.

The present disclosure will be further described in details below with reference to the drawings and embodiments. It can be understood that the embodiments described herein are only used to explain the present disclosure, rather than to limit the present disclosure. In addition, it should be noted that, in order to facilitate description, the drawings only show a part rather than all of the structures related to the present disclosure.

The terms used in the embodiments of the present disclosure are merely for the purpose of describing specific embodiments and not intended to limit the present disclosure. It should be noted that directional terms such as "upper", "lower", "left", and "right" described in the embodiments of the present disclosure are described from perspectives shown in the drawings and should not be interpreted as limitations to the embodiments of the present disclosure. In addition, in this context, it should also be understood that when referring to one element being formed "on" or "under" another element, not only can it be formed directly "on" or "under" another element, but it can also be formed "on" or "under" another element indirectly through an intermediate element. The terms "first", "second", etc. are for descriptive purposes only and do not represent any order, quantity, or importance, but are only used to distinguish different components. Those of ordinary skill in the art can understand the specific meanings of the above terms in the present disclosure according to specific situations.

A traditional display device generally includes a display panel part and a display driving chip part. The display panel part generally adopts a glass substrate, and row scanning circuits, pixel units, and light-emitting elements are all included in the display panel part. The display driving chip part is generally a circuit part that uses a silicon substrate, and includes a source driver (data driving), a data receiving and processing portion, a gray scale voltage generating portion. etc.

Figure 2:
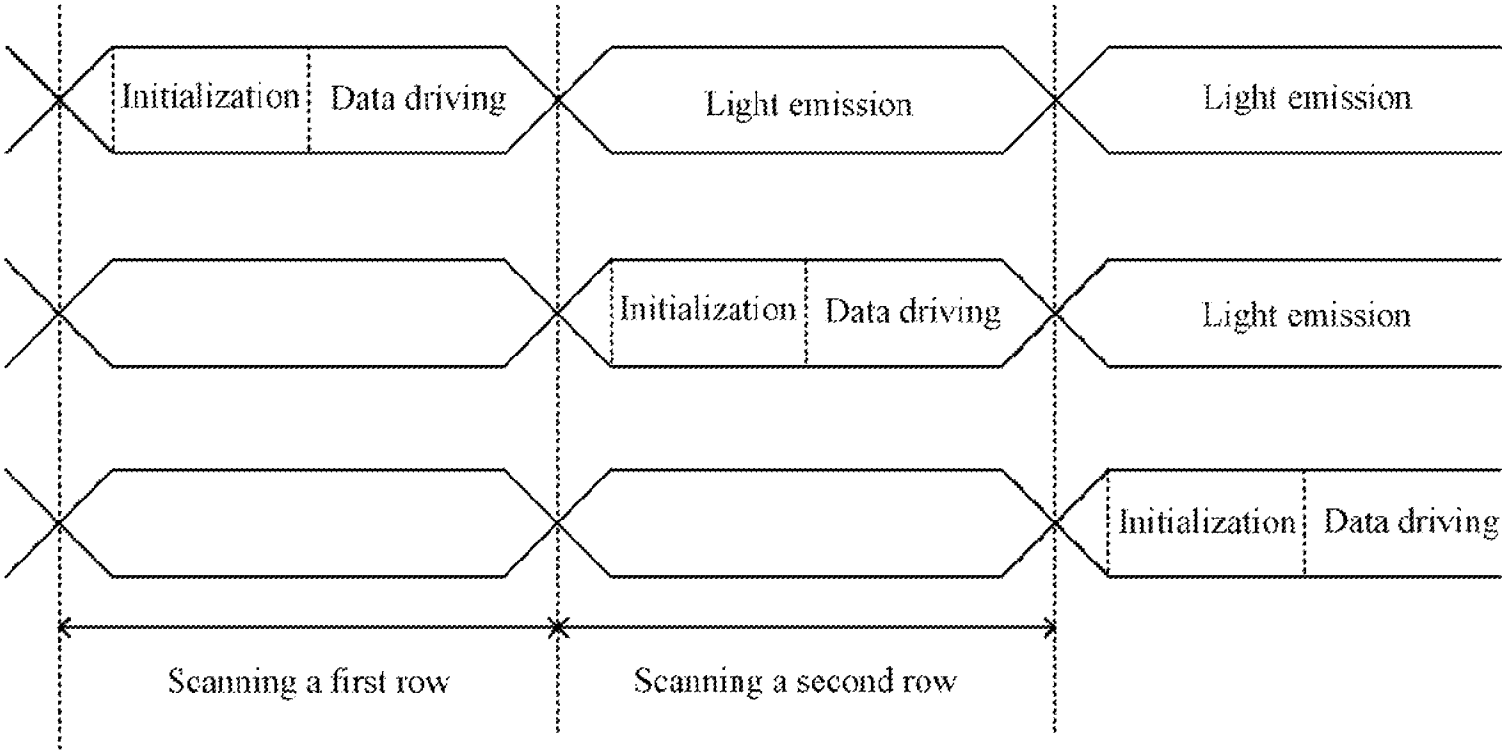
FIG. 2 (Prior Art)
FIG. 2 illustrates a driving timing sequence of the source driving circuit in FIG. 1.

For an operation process for display, operations including initialization, writing data by driving a data line, etc. are generally required to be performed within scanning time of one row. A case in which one source driver drives one column of pixels is taken as an example in the following. FIG. 1 illustrates a structural schematic diagram of a source driving circuit of a display device in the related art. Referring to FIG. 1, the source driving circuit includes: an initialization circuit 011, a data generating circuit 012, a data writing circuit 013, a data line 021, and a pixel driving circuit 022. The initialization circuit 011, the data generating circuit 012, and the data writing circuit 013 are located in a display driving part 01, and the data line 021 and the pixel driving circuit 022 are located in a display panel part 02. The data writing circuit 013 may be an operational amplifier. An output terminal of the operational amplifier is connected to pixel driving circuits 022 of the pixels in one column through the data line 021. FIG. 2 illustrates a driving timing sequence of the source driving circuit in FIG. 1. Referring to FIG. 1 and FIG. 2, when scanning a first row of pixels, first, a reset switch in the initialization circuit 011 is switched on (RST=1), and an initialization voltage VREF is written into the pixel driving circuit 022 through the operational amplifier, so as to complete the initialization; then, a data signal is written into the pixels through the operational amplifier according to the gray-scale voltage selected for the data; when the time of this row is over, the data writing is completed, and light emission begins; scanning of subsequent pixels are performed in sequence, to complete data transmission of one frame.

When resolution is relatively high, time of each operation phase will be very short, which cannot meet requirements of time and speed.

Figure 3:
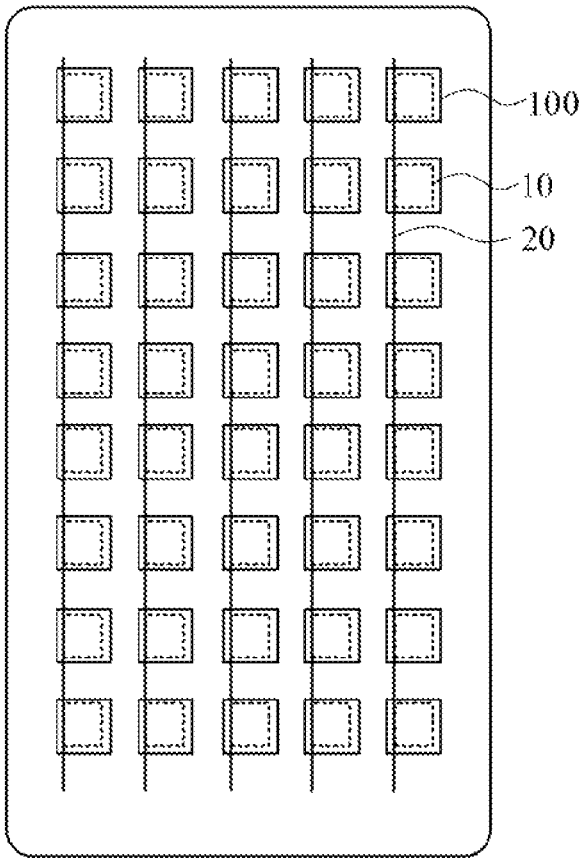
FIG. 3 illustrates a structural schematic diagram of a display panel according to an embodiment of the present disclosure.
Figure 4:
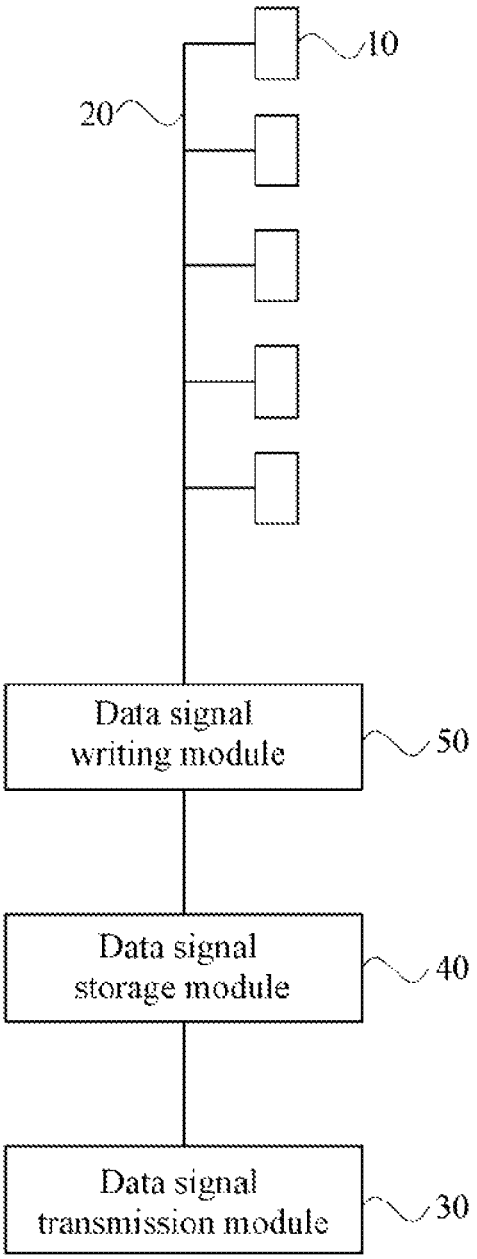
FIG. 4 illustrates a structural schematic diagram of a source driving circuit of a display panel according to an embodiment of the present disclosure.
Figure 5:
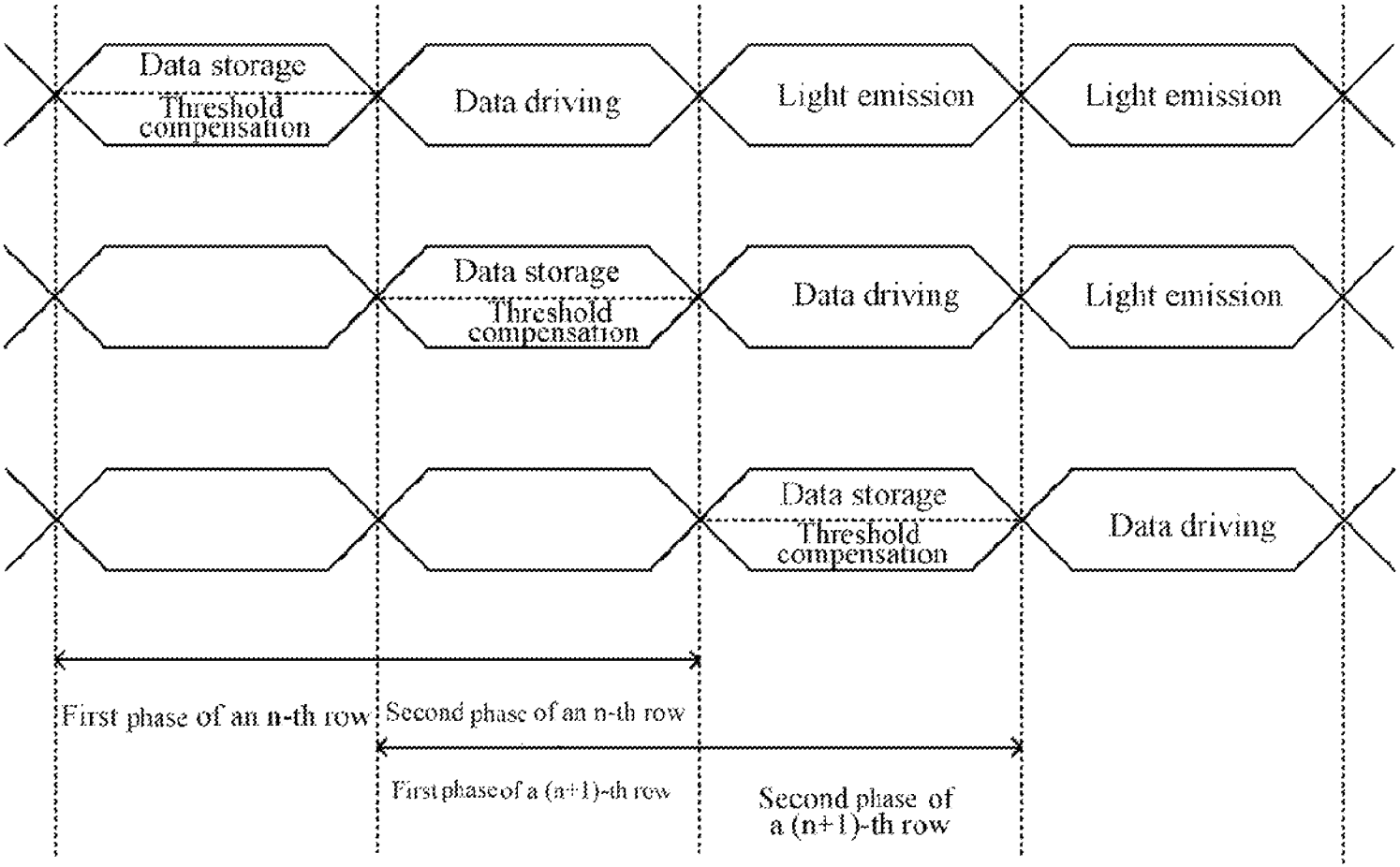
FIG. 5 illustrates a driving timing sequence of the source driving circuit in FIG. 4.

FIG. 3 illustrates a structural schematic diagram of a display panel according to an embodiment of the present disclosure, and FIG. 4 illustrates a structural schematic diagram of a source driving circuit of a display panel according to an embodiment of the present disclosure. Referring to FIG. 3 and FIG. 4, in order to solve the problem of insufficient pixel driving time in the case where the resolution of the display panel is relatively high, the display panel provided by this embodiment includes a plurality of sub-pixels 100 arranged in an array, and the pixel driving circuits 10 corresponding to the sub-pixels 100 in each column are connected through a data line 20. The display panel further includes a data signal transmission circuit 30, a data signal storage circuit 40, and a data signal writing circuit 50. An output terminal of the data signal transmission circuit 30 is connected to an input terminal of the data signal storage circuit 40, an output terminal of the data signal storage circuit 40 is connected to an input terminal of the data signal writing circuit 50, and an output terminal of the data signal writing circuit 50 is connected to the data line 20. FIG. 5 is a driving timing sequence of the source driving circuit in FIG. 4. Referring to FIGS. 4 and 5, each data driving process for the sub-pixels includes a first phase and a second phase. In the first phase, the data signal transmission circuit 30 is configured to write a data signal for an n-th row of sub-pixels into the data signal storage circuit 40. In the second phase, the data signal writing circuit 50 is configured to receive the data signal output from the data signal storage circuit 40 and write the data signal into the pixel driving circuits 10 corresponding to the sub-pixels in the n-th row, and the second phase of the data driving process for the n-th row of sub-pixels is reused as a first phase of a data driving process for a (n+1)-th row of sub-pixels, where n is a positive integer.

It can be understood that the display panel provided by the embodiment of the present disclosure may be a high-resolution display panel, for example, a silicon-based display panel. The silicon-based display panel uses a monocrystalline silicon wafer as a substrate, has a pixel size that is about 1/10 of that of a traditional display, and thus has advantages of low power consumption, small volume and high resolution. For example, the silicon-based display panel provided in the present embodiment is a liquid crystal on silicon display panel or an organic light-emitting on silicon display panel. The sub-pixels 100 may include red sub-pixels, green sub-pixels, and blue sub-pixels.

The technical solution of the embodiment of the present disclosure realizes the driving of high-resolution sub-pixels and eliminates contradiction between resolution and driving time by dividing one data driving process for the sub-pixels into the first phase and the second phase: in the first phase, the data signal transmission circuit is used to write the data signal for the n-th row of sub-pixels into the data signal storage circuit; and in the second phase, the data signal writing circuit is used to receive the data signal output from the data signal storage circuit and write the data signal into the pixel driving circuits corresponding to the sub-pixels in the n-th row, and the second phase of the data driving process for the n-th row of sub-pixels is reused into the first phase of the data driving process for the (n+1)-th row of the sub-pixels; where n is a positive integer.

Figure 6:
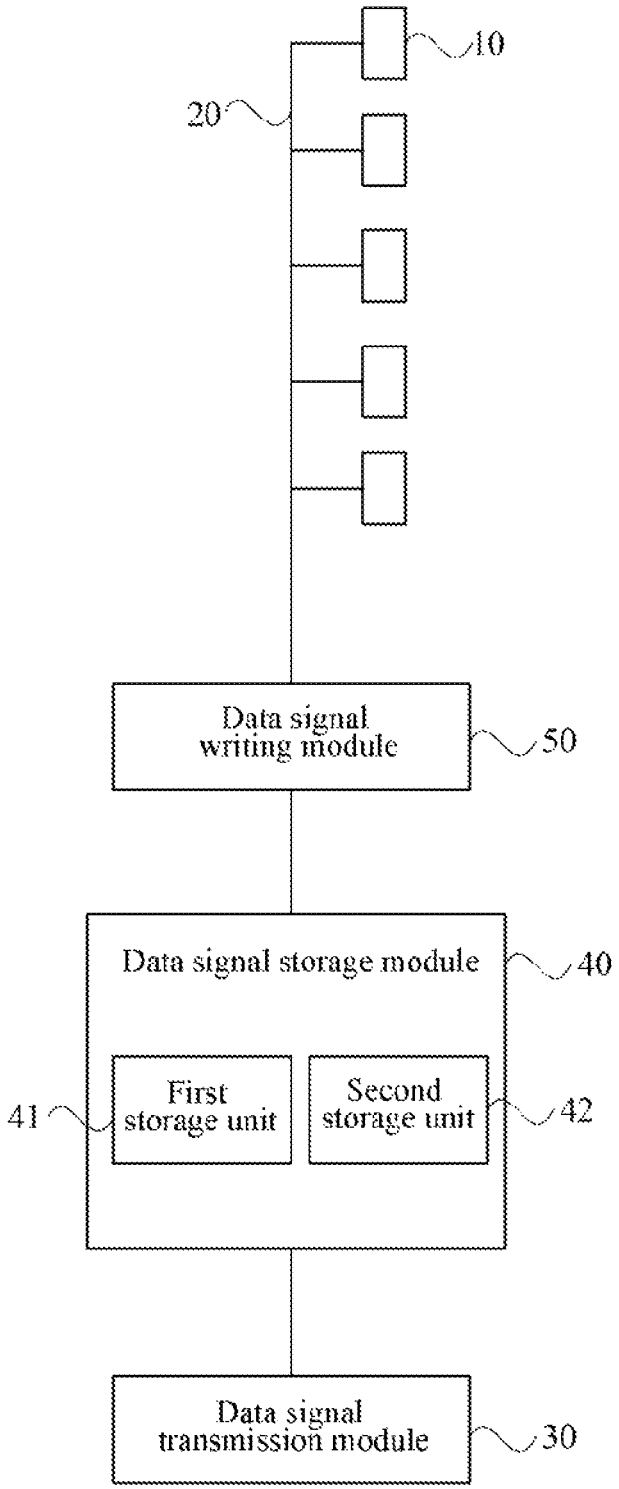
FIG. 6 illustrates a structural schematic diagram of a source driving circuit of another display panel according to an embodiment of the present disclosure.

FIG. 6 is a structural schematic diagram of a source driving circuit of another display panel according to an embodiment of the present disclosure based on the above embodiment. Referring to FIG. 6, the data signal storage circuit 40 includes a first storage unit 41 and a second storage unit 42. In the first phase, the data signal transmission circuit 30 is configured to write a first data signal for the n-th row of sub-pixels into the first storage unit 41. In the second phase, the data signal writing circuit 50 is configured to receive the first data signal outputted from the first storage unit 41 and write the first data signal into the pixel driving circuits 10 corresponding to the sub-pixels in the n-th row, and simultaneously, the data signal transmission circuit 30 writes a second data signal for the (n+1)-th row of sub-pixels into the second storage unit 42.

It can be understood that by setting the first storage unit 41 and the second storage unit 42, the first data signal required for the sub-pixels in the n-th row and the second data signal required for the sub-pixels in the (n+1)-th row can be stored in advance, impedance conversion is used to divide one data signal driving process for the sub-pixels into two phases—storage and writing, and the data signal storage of the (n+1)-th row and the data signal writing of the n-th row are performed simultaneously, so as to realize driving of the high-resolution display panel.

Figure 7:
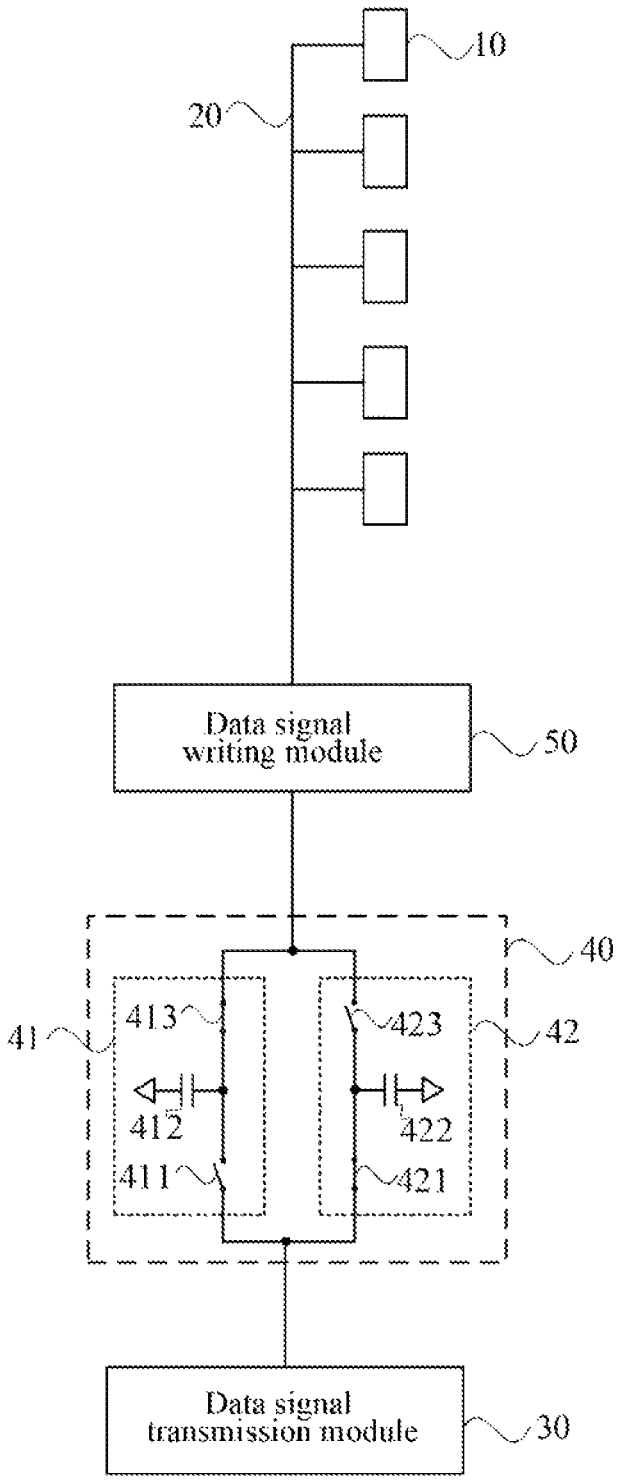
FIG. 7 illustrates a structural schematic diagram of a source driving circuit of still another display panel according to an embodiment of the present disclosure.

FIG. 7 is a structural schematic diagram of a source driving circuit of another display panel according to an embodiment of the present disclosure. Referring to FIG. 7, the first storage unit 41 includes a first switch 411, a first capacitor 412, and a second switch 413; the first switch 411 has a first terminal electrically connected to the output terminal of the data signal transmission circuit 30 and a second terminal electrically connected to a first terminal of the first capacitor 412, and a second terminal of the first capacitor 412 is grounded; the second switch 413 has a first terminal electrically connected to the first terminal of the first capacitor 412 and a second terminal electrically connected to the input terminal of the data signal writing circuit 50; the second storage unit 42 includes a third switch 421, a second capacitor 422, and a fourth switch 423; the third switch 421 has a first terminal electrically connected to the output terminal of the data signal transmission circuit 30 and a second terminal electrically connected to a first terminal of the second capacitor 422, and a second terminal of the second capacitor 422 is grounded; and the fourth switch 423 has a first terminal electrically connected to the first terminal of the second capacitor 422 and a second terminal electrically connected to the input terminal of the data signal writing circuit 50.

In an embodiment, with continued reference to FIG. 7, in the first phase of the data driving process for the n-th row of sub-pixels, the first switch 411 and the fourth switch 423 are switched on, the second switch 413 and the third switch 421 are switched off, and the data signal transmission circuit 30 writes the first data signal into the first capacitor 412; and in the second phase of the data driving process for the n-th row of sub-pixels, the second switch 413 and the third switch 421 are switched on, the first switch 411 and the fourth switch 423 are switched off, and the data signal writing circuit 50 is used to receive the first data signal output from the first capacitor 412 and write the first data signal into the pixel driving circuit 10 corresponding to the sub-pixels in the n-th row, and simultaneously, the data signal transmission circuit 30 writes the second data signal for the (n+1)-th row of sub-pixels into the second capacitor 422.

The working process for the source driving circuit shown in FIG. 7 is as follows.

In the first phase of scanning of the first row of sub-pixels, the data signal transmission circuit 30 writes the data for the first row of sub-pixels into the first capacitor 412; in the second phase of scanning of the first row of sub-pixels, the data signal transmission circuit 30 is disconnected from the first capacitor 412, and the first capacitor 412 is connected to the input terminal of the data signal writing circuit 50, to drive the first row of sub-pixels using the data written in the first capacitor 412, i.e., to perform data driving of the first row of sub-pixels. Simultaneously with the second phase of scanning of the first row of sub-pixels, a first phase of scanning of the second row of sub-pixels is performed, in which the data signal transmission circuit 30 is connected to the second capacitor 422, to write data for the second row of sub-pixels to the second capacitor 422. In a second phase of scanning of the second row of sub-pixels, the data driving of the first row of sub-pixels is completed, sub-pixels in the first row are electrically disconnected from the data line, and light emission of the first row of sub-pixels begins; the data signal transmission circuit 30 is electrically disconnected from the second capacitor 422, and the second capacitor 422 is connected to the input terminal of the data signal writing circuit 50, to drive the second row of sub-pixels using the data written in the second capacitor 422, i.e., to perform data driving of the second row of sub-pixels. Simultaneously with the second phase of scanning of the second row of sub-pixels, a first phase of scanning of the third row of sub-pixels is performed, in which the data signal transmission circuit 30 is connected to the first capacitor 412, to write data for the third row of sub-pixels into the first capacitor 412.

In a second phase of scanning of the third row of sub-pixels, the data driving of the second row of sub-pixels is completed, the sub-pixels in the second row are electrically disconnected from the data line, and light emission of the second row of sub-pixels begins; the data signal transmission circuit 30 is electrically disconnected from the first capacitor 412, and the first capacitor 412 is connected to the input terminal of the data signal writing circuit 50, to drive the third row of sub-pixels using the data written in the first capacitor 412, to perform data driving of the third row of sub-pixels. Simultaneously with the second phase of scanning of the third row of sub-pixels, a first phase of scanning of the fourth row of sub-pixels is performed, in which the data signal transmission circuit 30 is connected to the second capacitor 422 to write data for the fourth row of sub-pixels into the second capacitor 422.

The data of an entire frame is written in sequence and then the light emission is completed. In this way, the impedance conversion is achieved in such a manner that the impedance is converted from an original data line load to a capacitance of the first capacitor 412 or the second capacitor 422. A capacitance value of the first capacitor 412 and the second capacitor 422 can be multiple times smaller than a capacitance value of the data line, thereby reducing a load of the source driving circuit. Meanwhile, writing data into the capacitor and the data driving can also be operated in a time division multiplexing manner.

Figure 8:
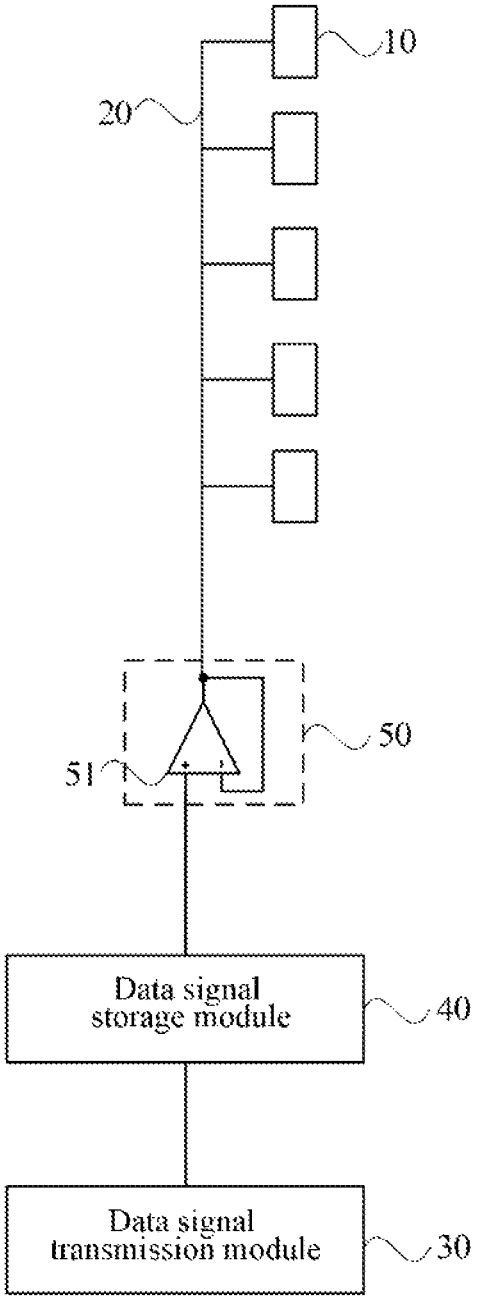
FIG. 8 illustrates a structural schematic diagram of a source driving circuit of yet another display panel according to an embodiment of the present disclosure.

FIG. 8 is a structural schematic diagram of a source driving circuit of yet another display panel according to an embodiment of the present disclosure. Referring to FIG. 8, the pixel driving circuits 10 corresponding to the sub-pixels in each column are connected through one data line 20; the data signal writing circuit 50 includes a first operational amplifier 51, a non-inverting input terminal of the first operational amplifier 51 is electrically connected to the output terminal of the data signal storage circuit 40, and an inverting input terminal and an output terminal of the first operational amplifier 51 are electrically connected to the data line 20.

It can be understood that the first operational amplifier 51 is configured to amplify the data signal required by each sub-pixel provided by the data signal storage circuit 40, so that the data signal storage circuit 40 only needs to store a proportional relationship between the data signals for different sub-pixels, thereby reducing the load of the data signal transmission circuit 30.

Figure 9:
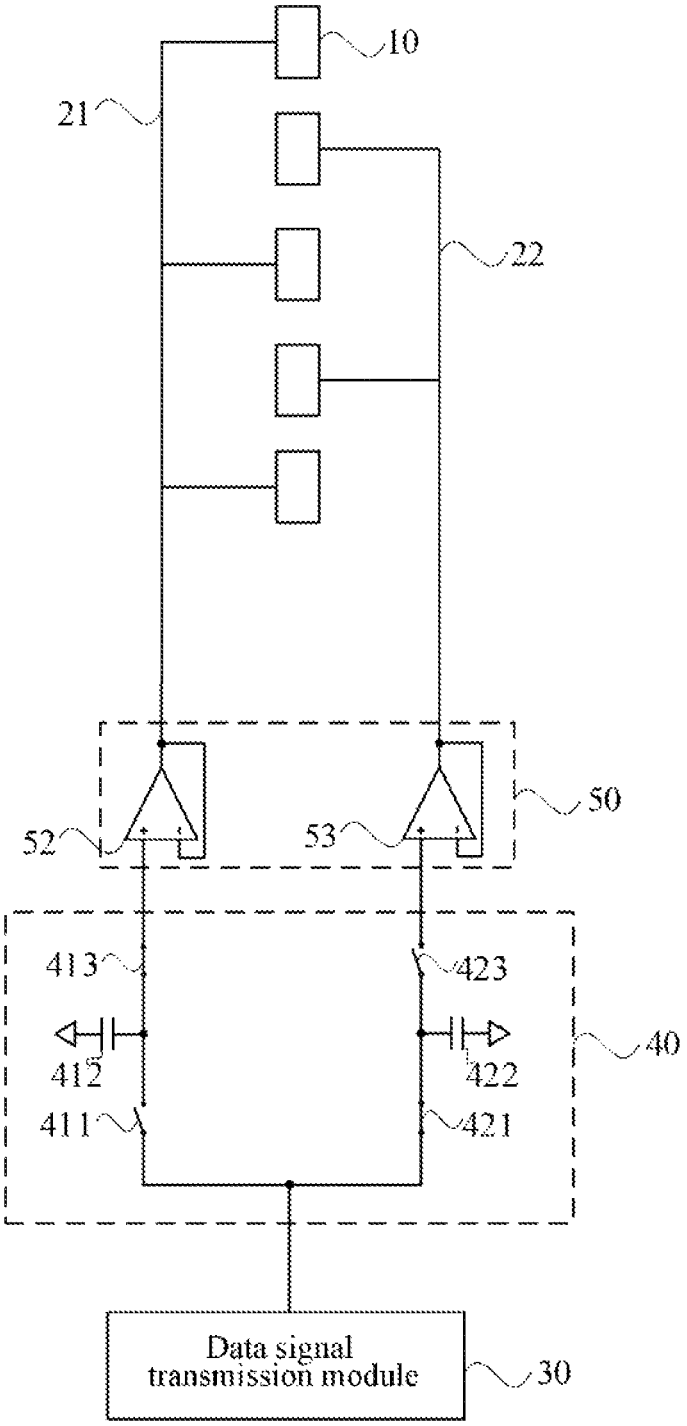
FIG. 9 illustrates a structural schematic diagram of a source driving circuit of yet another display panel according to an embodiment of the present disclosure.

In the embodiments provided in FIG. 6 and FIG. 7, staring from the scanning of the first row of sub-pixels, the data signal writing circuit 50 will always be in a data driving state. FIG. 9 illustrates a structural schematic diagram of a source driving circuit of yet another display panel according to an embodiment of the present disclosure. Referring to FIG. 9, in order to avoid the data signal writing circuit 50 from working all the time, the pixel driving circuits 10 corresponding to the sub-pixels in each column are electrically connected through two data lines, in such a manner that pixel driving circuits 10 corresponding to sub-pixels in odd-numbered rows of the column are electrically connected through a first data line 21, and pixel driving circuits 10 corresponding to sub-pixels in even-numbered rows of the column are electrically connected through a second data line 22; the data signal writing circuit 50 includes a second operational amplifier 52 and a third operational amplifier 53, a non-inverting input terminal of the second operational amplifier 52 is electrically connected to the second terminal of the second switch 413, and an inverting input terminal and an output terminal of the second operational amplifier 52 are electrically connected to the first data line 21; and a non-inverting input terminal of the third operational amplifier 53 is electrically connected to the second terminal of the fourth switch 423, and an inverting input terminal and an output terminal of the third operational amplifier 53 are electrically connected to the second data line 22.

A working process for the source driving circuit shown in FIG. 9 is as follows.

In the first phase of scanning of the first row of sub-pixels, the data signal transmission circuit 30 writes the data for the first row of sub-pixels into the first capacitor 412; and in the second phase of scanning of the first row of sub-pixels, the data signal transmission circuit 30 is disconnected from the first capacitor 412, and the first capacitor 412 is connected to the input terminal of the second operational amplifier 52, to drive the first row of sub-pixels using the data written in the first capacitor 412, i.e., to perform data driving of the first row. Simultaneously with the second phase of scanning of the first row of sub-pixels, the first phase of scanning of the second row of sub-pixels is performed, in which the data signal transmission circuit 30 is connected to the second capacitor 422, to write the data for the second row of sub-pixels into the second capacitor 422. In the second phase of scanning of the second row of sub-pixels, the data driving of the first row of sub-pixels is completed, sub-pixels in the first row are electrically disconnected from the data line, light emission of the first row of sub-pixels begins, the data signal transmission circuit 30 is electrically disconnected from the second capacitor 422, and the second capacitor 422 is connected to the input terminal of the third operational amplifier 53 to drive the second row of sub-pixels using the data written in the second capacitor 422, i.e., to perform data driving of the second row of sub-pixels. Simultaneously with the second phase of scanning of the second row of sub-pixels, the first phase of scanning of the third row of sub-pixels is performed, in which the data signal transmission circuit 30 is connected to the first capacitor 412, to write the data for the third row of sub-pixels into the first capacitor 412.

In the second phase of scanning of the third row of sub-pixels, sub-pixels in the second row are disconnected from the data line, to complete the data driving of the second row of sub-pixels so that light emission of the second row begins, the data signal transmission circuit 30 is disconnected from the first capacitor 412, and the first capacitor 412 is connected to the input terminal of the second operational amplifier 52, to drive the third row of sub-pixels using the data written into the first capacitor 412, i.e., to perform data driving of the third row of sub-pixels. Simultaneously with the second phase of scanning of the third row of sub-pixels, the first phase of scanning of the fourth row of sub-pixels is performed, in which the data signal transmission circuit 30 is connected to the second capacitor 422, to write the data for the fourth row of sub-pixels into the second capacitor 422.

Data of the entire frame is written in sequence and the light emission of all the rows of sub-pixels is completed. In this way, the second operational amplifier 52 and the third operational amplifier 53 can complete the data writing and data driving operations in a time division multiplexing manner.

Figure 10:
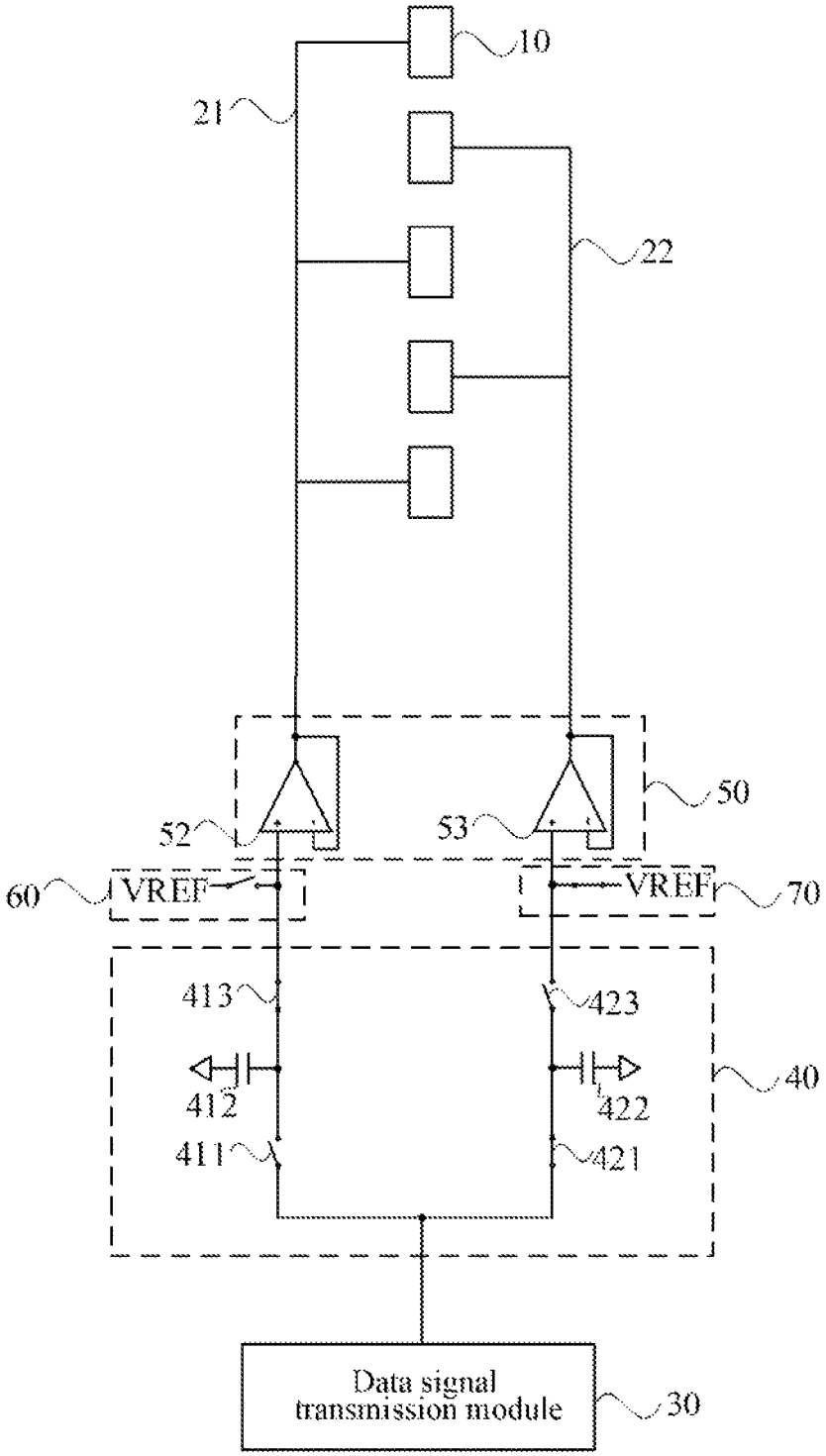
FIG. 10 illustrates a structural schematic diagram of a source driving circuit of yet another display panel according to an embodiment of the present disclosure.

In other embodiments, the sub-pixel driving process also includes an initialization operation. FIG. 10 illustrates a structural schematic diagram of a source driving circuit of yet another display panel according to an embodiment of the present disclosure. Referring to FIG. 10, the source driving circuit of the display panel provided in the present embodiment further includes a first initialization circuit 60 and a second initialization circuit 70, an output terminal of the first initialization circuit 60 is electrically connected to the output terminal of the second switch 413, the first initialization circuit 60 is configured to initialize the pixel driving circuits 10 of the sub-pixels in the odd-numbered rows, an output terminal of the second initialization circuit 70 is electrically connected to the output terminal of the fourth switch 423, and the second initialization circuit 70 is configured to initialize the pixel driving circuits 10 of the sub-pixels in the even-numbered rows.

Figure 11:
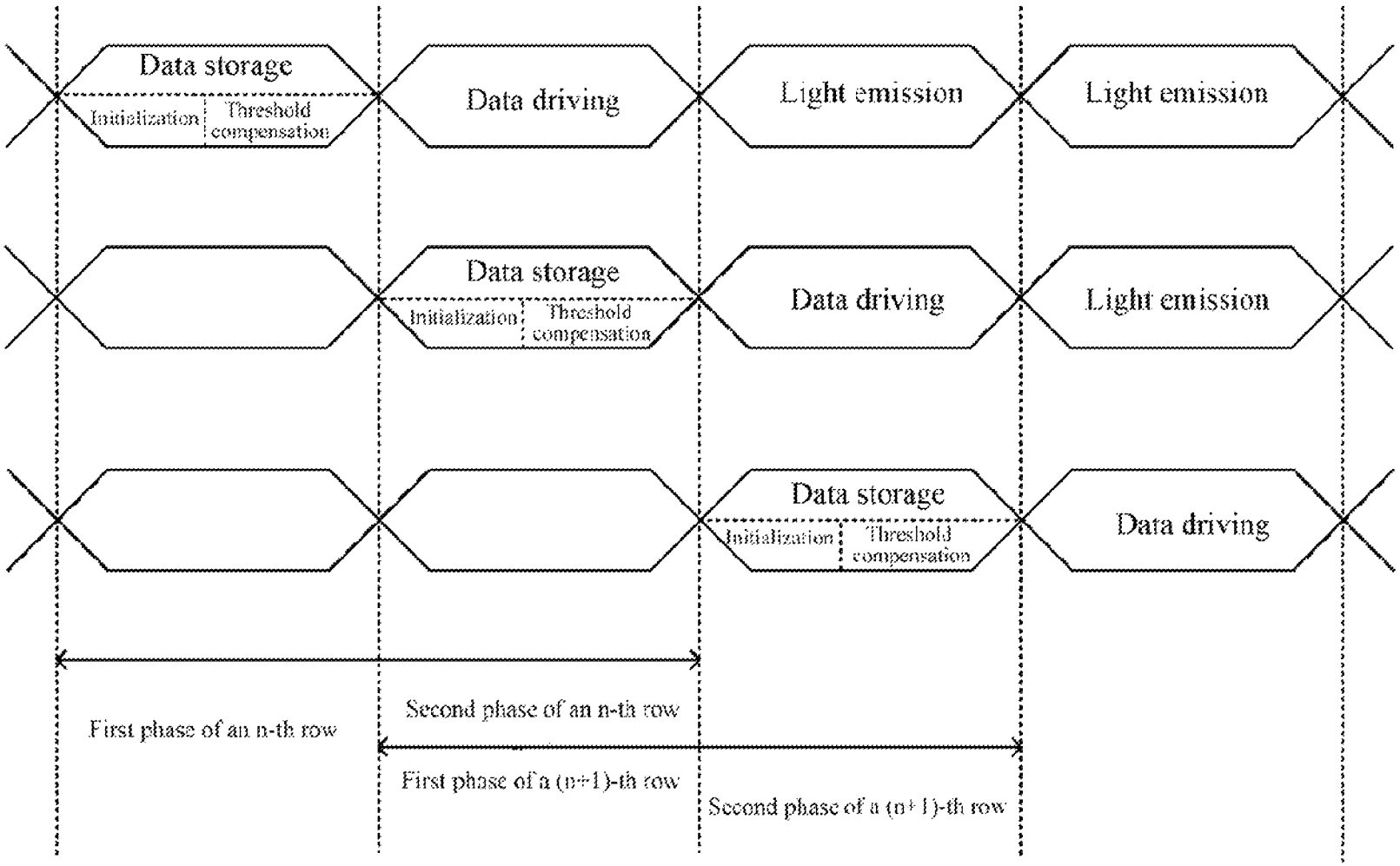
FIG. 11 illustrates a driving timing sequence of the source driving circuit in FIG. 10.

FIG. 11 illustrates a driving timing sequence of the source driving circuit in FIG. 10. Referring to FIG. 10 and FIG. 11, in the first phase of scanning of the first row of sub-pixels, the first initialization circuit 60 writes, through the second operational amplifier 52, an initialization voltage VREF into the first row of sub-pixels for initialization, and simultaneously, the data signal transmission circuit 30 writes the data for the first row of sub-pixels into the first capacitor 412; and in the second phase of scanning of the first row of sub-pixels, the second initialization circuit 70 writes, through the third operational amplifier 53, an initialization voltage VREF into the second row of sub-pixels for initialization. Other operations are similar to those of the driving process for the source driving circuit shown in FIG. 9, and only the corresponding initialization operation needs to be added in the first phase of each row of sub-pixels. By initializing the sub-pixels before display, influence of the previous frame of display on the next frame of display can be avoided, so as to improve the display effect.

In an embodiment, with continued reference to FIG. 5 or FIG. 11, the data driving process further includes a threshold compensation phase within the first phase.

It can be understood that when the sub-pixel includes an organic light-emitting display diode (OLED), the driving process further includes the threshold compensation phase. In the present embodiment, the threshold compensation phase is set within the first phase.

Figure 12:
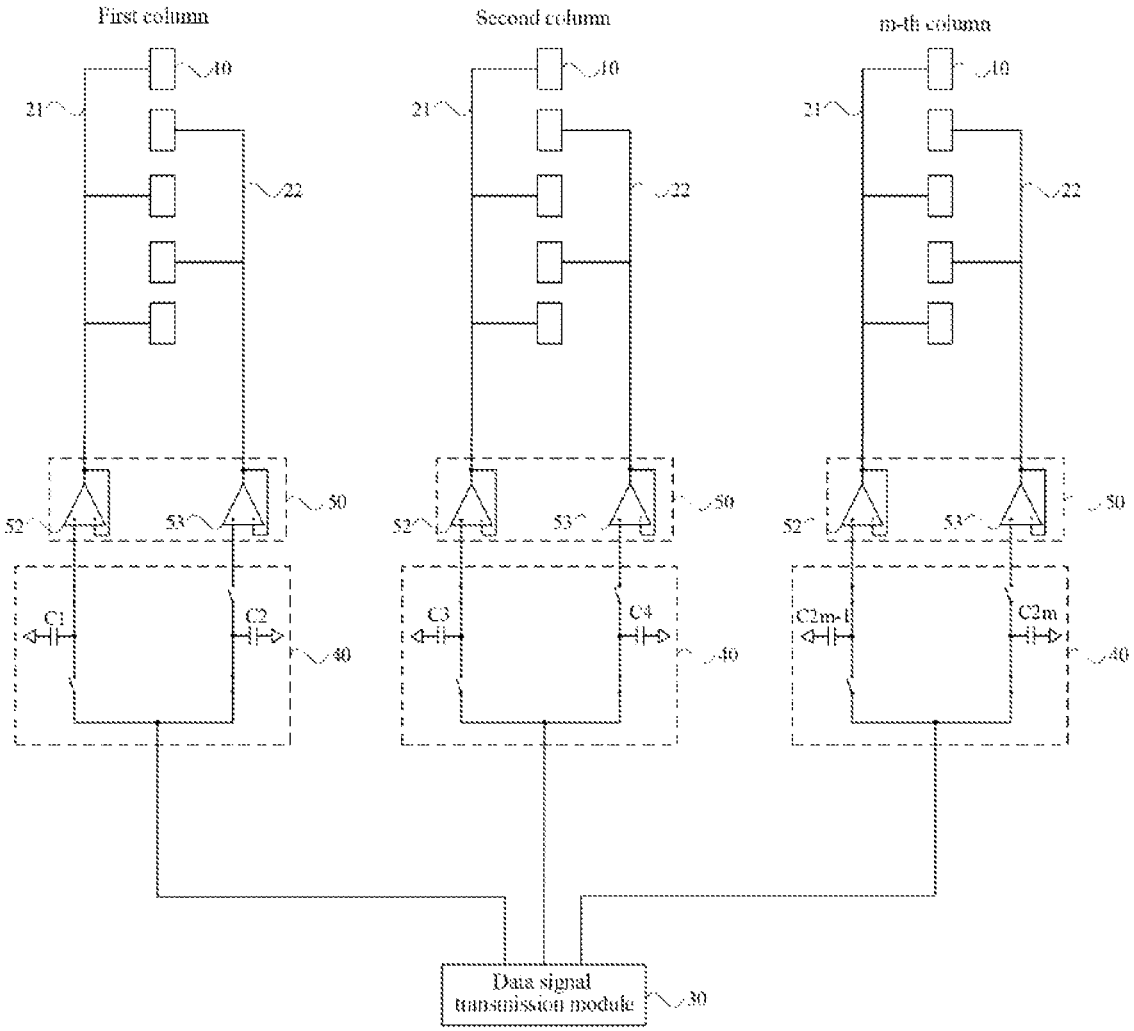
FIG. 12 illustrates a structural schematic diagram of a source driving circuit of yet another display panel according to an embodiment of the present disclosure.

FIG. 12 illustrates a structural schematic diagram of a source driving circuit of yet another display panel according to an embodiment of the present disclosure. Referring to FIG. 12, the data signal transmission circuit 30 includes one input terminal and m output terminals, and each output terminal of the data signal transmission circuit 30 is connected to an input terminal of one data signal storage circuit 40; where m is a positive integer.

It can be understood that when the impedance conversion and the time division multiplexing driving method of the present embodiment are adopted, the load of the display driving chip becomes smaller. Therefore, a multiplexer can be used to write the required data to a plurality of columns of capacitors in a time division multiplexing manner. That is, the data signal transmission circuit 30 may be provided with a plurality of output terminals, and each output terminal is connected to the input terminal of one data signal storage circuit 40.

Figure 13:
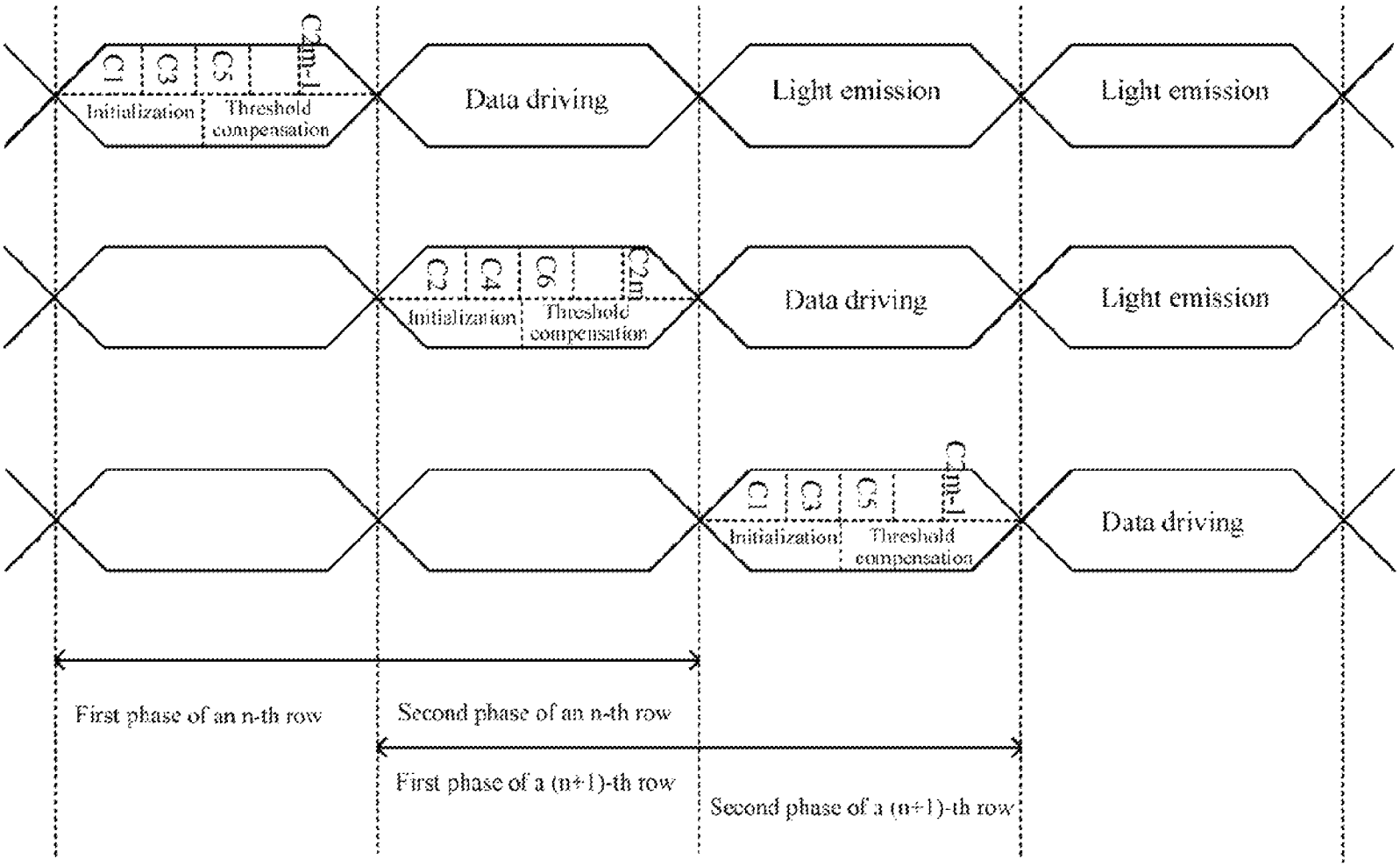
FIG. 13 illustrates a driving timing sequence of the source driving circuit in FIG. 12.

FIG. 13 illustrates a driving timing sequence of the source driving circuit in FIG. 12. A difference from the above embodiment is that the phase of writing data to the capacitors is different. Referring to FIG. 12, one data signal transmission circuit 30 corresponds to m columns of pixel driving circuits 10, writing data for an odd-numbered row of sub-pixels is performed by writing corresponding data sequentially into a capacitor C1 of a first column, a capacitor C3 of second column . . . a capacitor C2*m*−1 of an m-th column, the entire data writing time occupies time of one phase, and within this one phase, the odd-numbered row of sub-pixels in the m columns of sub-pixels are in a state of resetting first and then threshold compensation.

Then when proceeding to a next row, i.e., an even-numbered row, the odd-numbered row of sub-pixels in the m columns of sub-pixels are simultaneously driven by the second operational amplifier 52 and the third operational amplifier 53 corresponding to each column, in response to the data written into the capacitors in the previous phase, which occupies time of one phase; and simultaneously with this one phase, the data signal transmission circuit 30 sequentially writes corresponding data into a capacitor C2 of a first column, a capacitor C4 of second column . . . a capacitor C2*m* of an m-th column, the entire writing data time occupies time of one phase, and in this one phase, the even-numbered row of sub-pixels in them columns of sub-pixels are in a state of resetting first and then threshold compensation.

Then, when proceeding to a next row, i.e., another odd-numbered row, the even-numbered row of sub-pixels in the m columns are simultaneously driven by the second operational amplifier 52 and the third operational amplifier 53 corresponding to each column, in response to the data written into the capacitors in the previous phase, which occupies one phase of time. In this way, the data writing and light emission of one frame are completed sequentially.

In FIG. 13, C1 represents writing corresponding data into the capacitor C1, and C2 represents writing corresponding data into the capacitor C2. Similarly, C2*m*−1 represents writing corresponding data to the capacitor C2*m*−1, and C2*n* represents writing corresponding data to the capacitor C2*n*.

The technical solution of the present embodiment adopts the impedance conversion and time division multiplexing operations, and therefore, the display panel part and the display driving chip part do not have to be manufactured on the same silicon substrate. Then, for high-resolution display products, more advanced technology can be used to achieve a high speed for the data receiving, data processing and source driving, while the display panel part may be manufactured with a less advanced process due to a relatively large area of the display region to help reduce costs.

Figure 14:
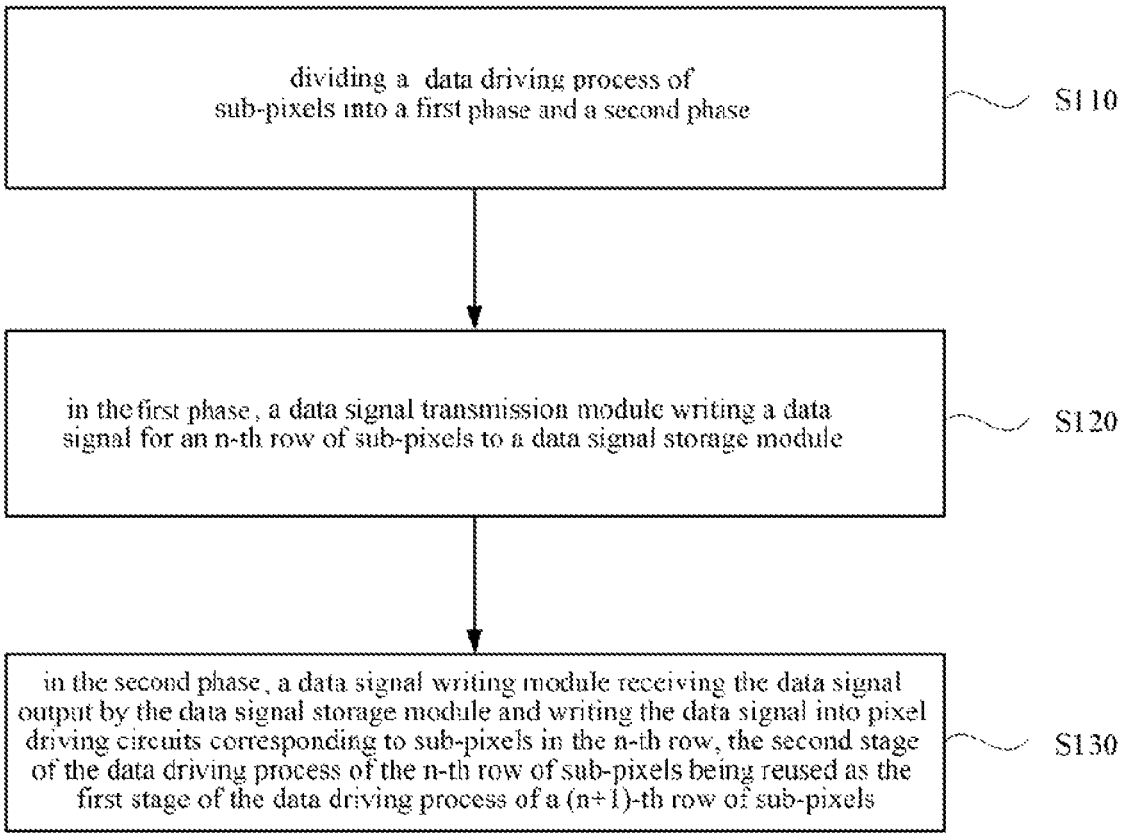
FIG. 14 illustrates a flowchart of a driving method of a display panel according to an embodiment of the present disclosure.

FIG. 14 is a schematic flowchart of a driving method of a display panel according to an embodiment of the present disclosure. The driving method provided in the present embodiment is applicable to any display panel provided in the above embodiments, and the driving method of the display panel includes: step S110, dividing one data driving process for sub-pixels into a first phase and a second phase; step S120, in the first phase, writing, by a data signal transmission circuit, a data signal for an n-th row of sub-pixels to a data signal storage circuit; and step S130, in the second phase, a data signal writing circuit receiving the data signal output by the data signal storage circuit and writing the data signal into pixel driving circuits corresponding to sub-pixels in the n-th row, the second phase of the data driving process for the n-th row of sub-pixels being reused as the first phase of the data driving process for a (n+1)-th row of sub-pixels, where n is a positive integer.

The driving method of the display panel provided by the embodiment of the present disclosure realizes the driving of high-resolution sub-pixels and eliminates the contradiction between resolution and driving time by dividing one data driving process for the sub-pixels into a first phase and a second phase: in the first phase, the data signal transmission circuit is used to write the data signal for the n-th row of sub-pixels into the data signal storage circuit, and in the second phase, the data signal writing circuit is used to receive the data signal output by the data signal storage circuit and write the data signal into the pixel driving circuits corresponding to the sub-pixels in the n-th row, while the second phase of the data driving process for the n-th row of sub-pixels is reused as the first phase of the data driving process for the (n+1)-th row of sub-pixels, where n is a positive integer.

An embodiment of the present disclosure further provides a display device including any one of the display panels provided in the above embodiments. The display device may be a VR, AR device or the like.

Since the display device provided by the embodiment of the present disclosure includes any one of the display panels provided by the above embodiments, and has the same or corresponding technical effects as that of the display panel, which will not be described in details here.

In an embodiment, the display device provided in the above embodiment further includes a driving chip used to provide a data signal to the data signal transmission circuit.

Note that the above are only the preferred embodiments of the present disclosure and the technical principles applied. Those skilled in the art will understand that the present disclosure is not limited to the specific embodiments described herein, and it is possible for those skilled in the art to make various obvious changes, readjustments, combinations and substitutions without departing from the protection scope of the present disclosure. Therefore, although the present disclosure has been described in details through the above embodiments, the present disclosure is not limited to the above embodiments and may include other equivalent embodiments without departing from the concept of the present disclosure, while the scope of the present disclosure is determined by the scope of the appended claims.

What is claimed is:

1. A display panel, comprising:

a plurality of sub-pixels arranged in an array, wherein pixel driving circuits corresponding to sub-pixels in each column of the plurality of sub-pixels are connected through at least one data line;

a data signal transmission circuit;

a data signal storage circuit; and a data signal writing circuit, wherein an output terminal of the data signal transmission circuit is connected to an input terminal of the data signal storage circuit, an output terminal of the data signal storage circuit is connected to an input terminal of the data signal writing circuit, and an output terminal of the data signal writing circuit is connected to the at least one data line, wherein a data driving process for the plurality of sub-pixels comprises: a first phase in which the data signal transmission circuit is configured to write a data signal for an n-th row of sub-pixels of the plurality of sub-pixels into the data signal storage circuit, and a second phase in which the data signal writing circuit is configured to receive the data signal output by the data signal storage circuit and write the data signal into pixel driving circuits corresponding to sub-pixels in the n-th row, and the second phase of the data driving process for the n-th row of sub-pixels is reused as the first phase of the data driving process for a (n+1)-th row of sub-pixels of the plurality of sub-pixels, where n is a positive integer, wherein the data signal storage circuit comprises a first storage unit and a second storage unit, wherein the first storage unit comprises a first switch, a first capacitor, and a second switch, and the second storage unit comprises a third switch, a second capacitor, and a fourth switch, and wherein the first switch has a first terminal electrically connected to the output terminal of the data signal transmission circuit and a second terminal electrically connected to a first terminal of the first capacitor, and a second terminal of the first capacitor is grounded, the second switch has a first terminal electrically connected to the first terminal of the first capacitor and a second terminal electrically connected to the input terminal of the data signal writing circuit, the third switch has a first terminal electrically connected to the output terminal of the data signal transmission circuit and a second terminal electrically connected to a first terminal of the second capacitor, and a second terminal of the second capacitor is grounded, and the fourth switch has a first terminal electrically connected to the first terminal of the second capacitor and a second terminal electrically connected to the input terminal of the data signal writing circuit.

2. The display panel according to claim 1, wherein in the first phase, the data signal transmission circuit writes a first data signal for the n-th row of sub-pixels into the first storage unit, and in the second phase, the data signal writing circuit receives the first data signal output by the first storage unit and writes the first data signal into the pixel driving circuits corresponding to the sub-pixels in the n-th row, and the data signal transmission circuit writes a second data signal for the (n+1)-th row of sub-pixels into the second storage unit.

3. The display panel according to claim 1, wherein: in the first phase of the data driving process for the n-th row of sub-pixels, the first switch and the fourth switch are switched on, the second switch and the third switch are switched off, and the data signal transmission circuit writes the first data signal into the first capacitor; and in the second phase of the data driving process for the n-th row of sub-pixels, the second switch and the third switch are switched on, the first switch and the fourth switch are switched off, the data signal writing circuit receives the first data signal output by the first capacitor and writes the first data signal into the pixel driving circuits corresponding to the sub-pixels in the n-th row, and the data signal transmission circuit writes the second data signal for the (n+1)-th row of sub-pixels into the second capacitor.

4. The display panel according to claim 1, wherein: the pixel driving circuits corresponding to the sub-pixels in each column are connected through one data line; and the data signal writing circuit comprises a first operational amplifier, a non-inverting input terminal of the first operational amplifier is electrically connected to the input terminal of the data signal storage circuit, and an inverting input terminal and an output terminal of the first operational amplifier are electrically connected to the one data line.

5. The display panel according to claim 1, wherein: pixel driving circuits corresponding to the sub-pixels in each column are electrically connected through two data lines in such a manner that pixel driving circuits corresponding to sub-pixels in odd-numbered rows of the column of sub-pixels are electrically connected through a first data line, and pixel driving circuits corresponding to sub-pixels in even-numbered rows of the column of sub-pixels are electrically connected through a second data line;

the data signal writing circuit comprises a first operational amplifier and a second operational amplifier, a non-inverting input terminal of the first operational amplifier is electrically connected to the second terminal of the second switch, and an inverting input terminal and an output terminal of the first operational amplifier are electrically connected to the first data line; and a non-inverting input terminal of the second operational amplifier is electrically connected to the second terminal of the fourth switch, and an inverting input terminal and an output terminal of the second operational amplifier are electrically connected to the second data line.

6. The display panel according to claim 5, further comprising a first initialization circuit and a second initialization circuit, wherein: an output terminal of the first initialization circuit is electrically connected to the output terminal of the second switch, and the first initialization circuit is configured to initialize the pixel driving circuits corresponding to the sub-pixels in the odd-numbered rows of the column of sub-pixels; and an output terminal of the second initialization circuit is electrically connected to the output terminal of the fourth switch, and the second initialization circuit is configured to initialize the pixel driving circuits corresponding to the sub-pixels in the even-numbered rows of the column of sub-pixels.

7. The display panel according to claim 5, wherein the data signal transmission circuit comprises one input terminal and m output terminals, and wherein each of the m output terminals of the data signal transmission circuit is connected to the input terminal of one data signal storage circuit, where m is a positive integer.

8. The display panel according to claim 1, wherein the data driving process further comprises a threshold compensation phase within the first phase.

9. The display panel according to claim 1, wherein the display panel is a silicon-based display panel.

* * * * *